US011572753B2

(12) United States Patent
Tonti

(10) Patent No.: US 11,572,753 B2
(45) Date of Patent: Feb. 7, 2023

(54) DOWNHOLE TOOL WITH AN ACID PILL

(71) Applicant: INNOVEX DOWNHOLE SOLUTIONS, INC., Houston, TX (US)

(72) Inventor: Nick Tonti, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 12 days.

(21) Appl. No.: 17/178,517

(22) Filed: Feb. 18, 2021

(65) Prior Publication Data

US 2021/0254421 A1 Aug. 19, 2021

Related U.S. Application Data

(60) Provisional application No. 62/978,022, filed on Feb. 18, 2020.

(51) Int. Cl.

| | |
|---|---|
| ***E21B 27/02*** | (2006.01) |
| ***E21B 43/28*** | (2006.01) |
| ***E21B 23/01*** | (2006.01) |

(52) U.S. Cl.

CPC ..... *E21B 27/02* (2013.01); *E21B 23/01* (2013.01); *E21B 43/28* (2013.01)

(58) Field of Classification Search

CPC ..... E21B 2200/08; E21B 33/00; E21B 27/02; E21B 23/01; E21B 43/28

See application file for complete search history.

(56) References Cited

U.S. PATENT DOCUMENTS

| | | | |
|---|---|---|---|
| 2,189,697 | A | 2/1940 | Baker |
| 2,222,233 | A | 11/1940 | Mize |
| 2,225,143 | A | 12/1940 | Baker et al. |
| 3,127,198 | A | 3/1964 | Orund |
| 3,746,093 | A | 7/1973 | Mullins |
| 3,860,067 | A | 1/1975 | Rodgers |

(Continued)

FOREIGN PATENT DOCUMENTS

| | | | |
|---|---|---|---|
| AR | 091776 | A1 | 2/2015 |
| AU | 2010214651 | A1 | 3/2012 |

(Continued)

OTHER PUBLICATIONS

Non-Final Office Action dated Apr. 15, 2021, U.S. Appl. No. 16/804,765, 13 pages.

(Continued)

*Primary Examiner* — Blake Michener

(74) *Attorney, Agent, or Firm* — MH2 Technology Law Group LLP

(57) ABSTRACT

A downhole tool includes a main body, and a setting member configured to press the main body radially outwards so as to set the main body with the surrounding tubular, made at least partially from a dissolvable material configured to dissolve in a well fluid, and defining a bore therein. The tool also includes an acid pill positioned in the bore of the setting member. The acid pill contains an acid therein, and is made at least partially from a dissolvable material configured to dissolve in the well fluid such that the acid mixes with the well fluid upon the acid pill at least partially dissolving. The acid mixed in the well fluid increases a rate at which the dissolvable material of the setting member dissolves in the well fluid.

22 Claims, 6 Drawing Sheets

(56) References Cited

U.S. PATENT DOCUMENTS 4,155,404 A 5/1979 Hollingsworth
4,483,399 A 11/1984 Colgate
4,901,794 A 2/1990 Baugh et al.
5,064,164 A 11/1991 Le
5,131,468 A 7/1992 Lane et al.
5,325,923 A 7/1994 Surjaatmadja et al.
5,396,957 A 3/1995 Surjaatmadja et al.
5,479,986 A 1/1996 Gano et al.
5,542,473 A 8/1996 Pringle
5,623,993 A 4/1997 Buskirk et al.
5,701,959 A 12/1997 Hushbeck et al.
5,709,269 A 1/1998 Head
5,984,007 A 11/1999 Yuan et al.
6,167,963 B1 1/2001 McMahan et al.
6,220,349 B1 4/2001 Vargus et al.
6,296,054 B1 10/2001 Kunz et al.
6,354,372 B1 3/2002 Carisella et al.
6,354,373 B1 3/2002 Vercaemer et al.
6,446,323 B1 9/2002 Metcalfe et al.
6,581,681 B1 6/2003 Zimmerman et al.
6,662,876 B2 12/2003 Lauilzen
6,684,958 B2 2/2004 Williams et al.
6,695,050 B2 2/2004 Winslow et al.
6,702,029 B2 3/2004 Metcalfe et al.
6,712,153 B2 3/2004 Turley et al.
6,722,437 B2 4/2004 Vercaemer et al.
6,793,022 B2 9/2004 Vick et al.
6,796,376 B2 9/2004 Frazier
6,796,534 B2 9/2004 Beyer et al.
7,048,065 B2 5/2006 Badrak et al.
7,093,656 B2 8/2006 Maguire
7,096,938 B2 8/2006 Carmody et al.
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Abercrombie Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Hailey, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,614,448 B2 11/2009 Swagerty et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
7,980,300 B2 7/2011 Roberts et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,584,746 B2 * 11/2013 Marya ..... E21B 33/12 166/376
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,776 B2 3/2015 Spray
8,991,485 B2 3/2015 Chenault et al.
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,228,404 B1 1/2016 Jackson et al.
9,309,733 B2 4/2016 Xu et al.
9,334,702 B2 5/2016 Allen et al.
9,382,790 B2 7/2016 Bertoja et al.
D762,737 S 8/2016 Fitzhugh
D763,324 S 8/2016 Fitzhugh
9,470,060 B2 10/2016 Young
9,574,415 B2 2/2017 Xu et al.
9,605,508 B2 3/2017 Xu et al.
D783,133 S 4/2017 Fitzhugh
9,752,423 B2 9/2017 Lynk
9,835,003 B2 12/2017 Harris
9,835,016 B2 * 12/2017 Zhang ..... E21B 43/14
D807,991 S 1/2018 Fitzhugh
9,909,384 B2 3/2018 Chauffe et al.
9,915,116 B2 * 3/2018 Jacob ..... E21B 27/02
9,927,058 B2 3/2018 Sue
9,976,379 B2 5/2018 Schmidt
9,976,381 B2 5/2018 Martin et al.
D827,000 S 8/2018 Van Lue
10,156,119 B2 12/2018 Martin et al.
10,400,531 B2 9/2019 Jackson et al.
10,408,012 B2 9/2019 Martin et al.
10,415,336 B2 9/2019 Benzie
10,533,392 B2 1/2020 Walton
10,605,018 B2 3/2020 Schmidt
10,648,275 B2 5/2020 Dirocco
10,920,523 B2 2/2021 Kellner et al.
2003/0062171 A1 4/2003 Maguire et al.
2003/0099506 A1 5/2003 Mosing
2003/0188876 A1 10/2003 Vick et al.
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0189103 A1 9/2005 Roberts et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.

(56) References Cited

U.S. PATENT DOCUMENTS

2006/0185855 A1 8/2006 Jordan et al.
2006/0272828 A1 12/2006 Manson
2007/0000664 A1 1/2007 Ring et al.
2007/0044958 A1 3/2007 Rytlewski et al.
2007/0272418 A1 11/2007 Corre et al.
2008/0066923 A1* 3/2008 Xu ..... E21B 23/00 166/376
2008/0073074 A1 3/2008 Frazier
2008/0135248 A1 6/2008 Talley et al.
2008/0135261 A1 6/2008 McGilvray et al.
2008/0142223 A1 6/2008 Xu et al.
2008/0190600 A1 8/2008 Shkurti et al.
2008/0264627 A1 10/2008 Roberts et al.
2008/0308266 A1 12/2008 Roberts et al.
2009/0044949 A1 2/2009 King et al.
2009/0065192 A1 3/2009 Lucas
2009/0065196 A1 3/2009 Holland et al.
2009/0205843 A1 8/2009 Gandikota et al.
2009/0242213 A1 10/2009 Braddick
2009/0266560 A1 10/2009 Ring et al.
2010/0032167 A1 2/2010 Adam et al.
2010/0038072 A1 2/2010 Akselberg
2010/0116489 A1 5/2010 Nelson
2010/0132960 A1 6/2010 Shkurti et al.
2010/0170682 A1 7/2010 Brennan, III
2010/0263857 A1 10/2010 Frazier
2010/0270031 A1 10/2010 Patel
2010/0270035 A1 10/2010 Ring et al.
2010/0276159 A1 11/2010 Mailand et al.
2010/0314127 A1 12/2010 Swor et al.
2010/0319427 A1 12/2010 Lohbeck
2010/0319927 A1 12/2010 Yokley et al.
2011/0005779 A1 1/2011 Lembcke
2011/0048743 A1 3/2011 Stafford et al.
2011/0088891 A1 4/2011 Stout
2011/0132143 A1 6/2011 Xu et al.
2011/0132619 A1 6/2011 Agrawal et al.
2011/0132621 A1 6/2011 Agrawal et al.
2011/0132623 A1 6/2011 Moeller
2011/0232899 A1 9/2011 Porter
2011/0240295 A1 10/2011 Porter et al.
2011/0266004 A1 11/2011 Hallundbaek et al.
2011/0284232 A1 11/2011 Huang
2012/0024109 A1 2/2012 Xu et al.
2012/0055669 A1 3/2012 Levin et al.
2012/0067583 A1 3/2012 Zimmerman et al.
2012/0097384 A1 4/2012 Valencia
2012/0111566 A1 5/2012 Sherman et al.
2012/0118583 A1 5/2012 Johnson et al.
2012/0132426 A1 5/2012 Xu et al.
2012/0168163 A1 7/2012 Bertoja et al.
2012/0199341 A1 8/2012 Kellner et al.
2012/0205873 A1 8/2012 Turley
2012/0247767 A1 10/2012 Themig et al.
2012/0273199 A1 11/2012 Cresswell et al.
2013/0008671 A1 1/2013 Booth
2013/0062063 A1 3/2013 Baihly et al.
2013/0081825 A1 4/2013 Lynde et al.
2013/0186615 A1 7/2013 Hallubaek et al.
2013/0186616 A1 7/2013 Xu et al.
2013/0192853 A1 8/2013 Themig
2013/0299185 A1 11/2013 Xu et al.
2014/0014339 A1 1/2014 O'Malley et al.
2014/0076571 A1 3/2014 Frazier et al.
2014/0131054 A1 5/2014 Raynal
2014/0209325 A1 7/2014 Dockweiler
2014/0224477 A1 8/2014 Wiese
2014/0238700 A1 8/2014 Williamson
2014/0262214 A1 9/2014 Mhaskar
2014/0352970 A1 12/2014 Kristoffer
2015/0027737 A1 1/2015 Rochen
2015/0068757 A1 3/2015 Hofman et al.
2015/0075774 A1 3/2015 Raggio
2015/0129215 A1 5/2015 Xu et al.
2015/0159462 A1* 6/2015 Cutler ..... E21B 34/14 166/377
2015/0184485 A1 7/2015 Xu et al.
2015/0218904 A1 8/2015 Chauffe et al.
2016/0160591 A1 6/2016 Xu
2016/0186511 A1 6/2016 Coronado et al.
2016/0290096 A1 10/2016 Tse
2016/0305215 A1 10/2016 Harris et al.
2016/0312557 A1 10/2016 Kitzman
2016/0333655 A1 11/2016 Fripp
2016/0376869 A1 12/2016 Rochen
2017/0022781 A1 1/2017 Martin
2017/0067328 A1 3/2017 Chauffe
2017/0101843 A1 4/2017 Waterhouse et al.
2017/0130553 A1 5/2017 Harris
2017/0146177 A1 5/2017 Sue
2017/0218711 A1 8/2017 Kash
2017/0260824 A1 9/2017 Kellner
2017/0370176 A1 12/2017 Frazier
2018/0030807 A1 2/2018 Martin
2018/0073325 A1 3/2018 Dolog
2018/0087345 A1 3/2018 Xu
2018/0266205 A1 9/2018 Martin
2018/0363409 A1 12/2018 Frazier
2019/0063179 A1 2/2019 Murphy
2019/0106961 A1 4/2019 Hardesty
2019/0203556 A1 7/2019 Powers
2019/0264513 A1 8/2019 Kosel
2019/0292874 A1 9/2019 Saeed
2020/0072019 A1 3/2020 Tonti
2020/0080396 A1* 3/2020 Subbaraman ..... E21B 33/1293
2020/0131882 A1 4/2020 Tonti
2020/0173246 A1 6/2020 Kellner
2020/0248521 A1 8/2020 Southard
2020/0256150 A1 8/2020 Kellner

FOREIGN PATENT DOCUMENTS

EP 2251525 A1 11/2010
GB 2345308 A 7/2000
GB 2448449 A 10/2008
GB 2448449 B 12/2008
GB 2482078 A 1/2012
WO 2010/039131 A1 4/2010
WO 2011/023743 A2 11/2011
WO 2011/137112 A2 11/2011
WO 2014/014591 A1 1/2014
WO 2014/100072 A1 6/2014
WO 2016/160003 A1 10/2016
WO 2017/151384 A1 9/2017

OTHER PUBLICATIONS

Non-Final Office Action dated May 12, 2021, U.S. Appl. No. 16/818,502, 7 pages.

Anjum et al., Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way, SPE International Oil & Gas Conference, Jun. 8-10, 2010, pp. 1-16.

Chakraborty et al., Drilling and Completions Services and Capabilities Presentation, Jan. 2018, Virtual Integrated Analytic Solutions, Inc., 33 pages.

Gorra et al., Expandable Zonal Isolation Barrier (ZIB) Provides a Long-Term Well Solution as a High Differential Pressure Metal Barrier to Flow, Brazilian Petroleum Technical Papers, 2010, Abstract only, 1 page.

Hinkie et al., Multizone Completion with Accurately Placed Stimulation Through Casing Wall, SPE Production and Operations Symposium, Mar. 13-Apr. 3, 2007, pp. 1-4.

Jackson et al., Slip Assembly, U.S. Appl. No. 13/361,477, filed Jan. 30, 2012.

Jackson et al., Slip Assembly, U.S. Appl. No. 14/987,255, filed Jan. 4, 2016.

Kellner et al., Downhole Tool Including a Swage, U.S. Appl. No. 29/689,996, filed May 3, 2019.

(56) References Cited

OTHER PUBLICATIONS

Kellner et al., Slip Segment for a Downhole Tool, U.S. Appl. No. 15/064,312, filed Mar. 8, 2016.
Kellner et al., Ball Drop Wireline Adapter Kit, U.S. Appl. No. 16/131,802, filed Sep. 14, 2018.
Kellner et al., Downhole Tool With Ball-In-Place Setting Assembly and Asymmetric Sleeve, U.S. Appl. No. 16/366,470, filed Mar. 27, 2019.
Kellner et al., Downhole Tool With Sleeve and Slip, U.S. Appl. No. 16/804,765, filed Feb. 28, 2020.
Kellner et al., Downhole Tool With Sealing Ring, U.S. Appl. No. 16/695,316, filed Nov. 11, 2019.
King et al., A Methodology for Selecting Interventionless Packer Setting Techniques, SPE-90678-MS, Society of Petroleum Engineers, 2004, pp. 1-3.
Larimore et al., Overcoming Completion Challenges with Intervention less Devices—Case Study—The "Disappearing Plug", SPE 63111, SPE International 2000, pp. 1-13.
Mailand et al., Non-Damaging Slips and Drillable Bridge Plug, U.S. Appl. No. 12/836,333, filed Jul. 14, 2010.
Martin et al., Downhole Tool With an Expandable Sleeve, U.S. Appl. No. 15/217,090, filed Jul. 22, 2016.
Martin et al., Downhole Tool With an Expandable Sleeve, U.S. Appl. No. 15/727,390, filed Oct. 6, 2017.
Martin et al., Downhole Tool With an Expandable Sleeve, U.S. Appl. No. 15/985,637, filed May 21, 2018.
Kellner et al., Deformable Downhole Tool With Dissolvable Element and Brittle Protective Layer, U.S. Appl. No. 16/677,993, filed Nov. 8, 2019.
Tonti et al., Downhole Tool With an Expandable Sleeve, Grit Material, and Button Inserts, U.S. Appl. No. 16/117,089, filed Aug. 30, 2018.
Tonti et al., Downhole Tool With Recessed Buttons, U.S. Appl. No. 16/662,792, filed Oct. 24, 2019.
Martin et al., Dowhnhole Tool and Methods, U.S. Appl. No. 16/818,502, filed Mar. 13, 2020.
Vargus et al., Completion System Allows for Interventionless Stimulation Treatments in Horizontal Wells with Multiple Shale Pay Zones, Annual SPE Technical Conference, Sep. 2008, Abstract only, 1 page.
Vargus et al., Completion System Allows for Interventionless Stimulation Treatments in Horizontal Wells with Multiple Shale Pay Zones, SPE Annual Technical Conference, Sep. 2008, pp. 1-8.
Vargus et al., System Enables Multizone Completions, The American Oil & Gas Reporter, 2009, Abstract only, 1 page.
World Oil, Slotted Liner Design for SAGD Wells ///, Jun. 2007, WorldOil.Com, https://www.worldoil.com/magazine/2007/June-2007/special-focus/slotted-liner-design-for-sagd-wells, 1 page.
Xu et al., Declaration Under 37 CFR 1.132, U.S. Appl. No. 14/605,365, filed Jan. 26, 2015, pp. 1-4.
Xu et al., Smart Nanostructured Materials Deliver High Reliability Completion Tools for Gas Shale Fracturing, SPE 146586, SPE International, 2011, pp. 1-6.
Zhang et al., High Strength Nanostructured Materials and Their Oil Field Applications, SPE 157092, SPE International, 2012, pp. 1-6.

* cited by examiner

DOWNHOLE TOOL WITH AN ACID PILL

CROSS-REFERENCE TO RELATED APPLICATIONS

This application claims priority to U.S. Provisional Patent Application having Ser. No. 62/978,022, which was filed on Feb. 18, 2020 and is incorporated herein by reference in its entirety.

BACKGROUND

In oil and gas wells, openings may be created in a production liner for injecting fluid into a formation. In a "plug and perf" frac job, for example, the production liner is made up from standard lengths of casing. Initially, the liner does not have any openings through its sidewalls. The liner is installed in the wellbore, either in an open bore using packers or by cementing the liner in place, and the liner walls are then perforated. The perforations are typically created by perforation guns that discharge shaped charges through the liner and, if present, adjacent cement.

The production liner is typically perforated first in a zone near the bottom of the well. Fluids then are pumped into the well to fracture the formation in the vicinity of the perforations. After the initial zone is fractured, a plug is installed in the liner at a position above the fractured zone to isolate the lower portion of the liner. The liner is then perforated above the plug in a second zone, and the second zone is fractured. This process is repeated until all zones in the well are fractured.

Plug and perf is widely practiced, but it has a number of drawbacks, including that it can be time consuming, because perforation guns and plugs are generally run into the well and operated individually. After the frac job is complete, the plugs are removed (e.g., drilled out) to allow production of hydrocarbons through the liner.

SUMMARY

Embodiments of the disclosure include a downhole tool including a main body, and a setting member configured to press the main body radially outwards so as to set the main body with the surrounding tubular. The setting member is made at least partially from a dissolvable material configured to dissolve in a well fluid, and the setting member defines a bore therein. The tool also includes an acid pill positioned in the bore of the setting member. The acid pill contains an acid therein, the acid pill is at least partially made from a dissolvable material configured to dissolve in the well fluid such that the acid mixes with the well fluid upon the acid pill at least partially dissolving, and the acid mixed in the well fluid increases a rate at which the dissolvable material of the setting member dissolves in the well fluid in comparison to the rate at which the dissolvable material of the setting member dissolves in the well fluid without the acid mixed therein.

Embodiments of the disclosure further include a downhole tool including a main body, a first cone received at least partially into a first end of the main body, and a second cone received at least partially into a second, opposite end of the main body. The first and second cones are configured to be advanced into the main body and adducted together so as to force the main body radially outward, and wherein the second cone comprises one or more bores therein. The tool further includes an acid pill received in one of the one or more bores, the acid pill containing an acid configured to mix with well fluid so as to increase a rate of dissolution of the second cone in the well fluid in comparison to a rate of dissolution of the second cone in the well fluid without the presence of the acid.

Embodiments of the disclosure also include a method including positioning an acid pill in a setting member of a downhole tool, deploying the downhole tool into a well, setting the downhole tool using the setting member to press at least a portion of the downhole tool radially outward, and exposing the downhole tool to a well fluid, wherein exposing the downhole tool to the well fluid causes at least a portion of the acid pill to dissolve, which exposes an acid contained within the acid pill to the well fluid such that that acid mixes with the well fluid, and wherein the acid mixed with the well fluid causes at least a portion of the downhole tool to dissolve.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
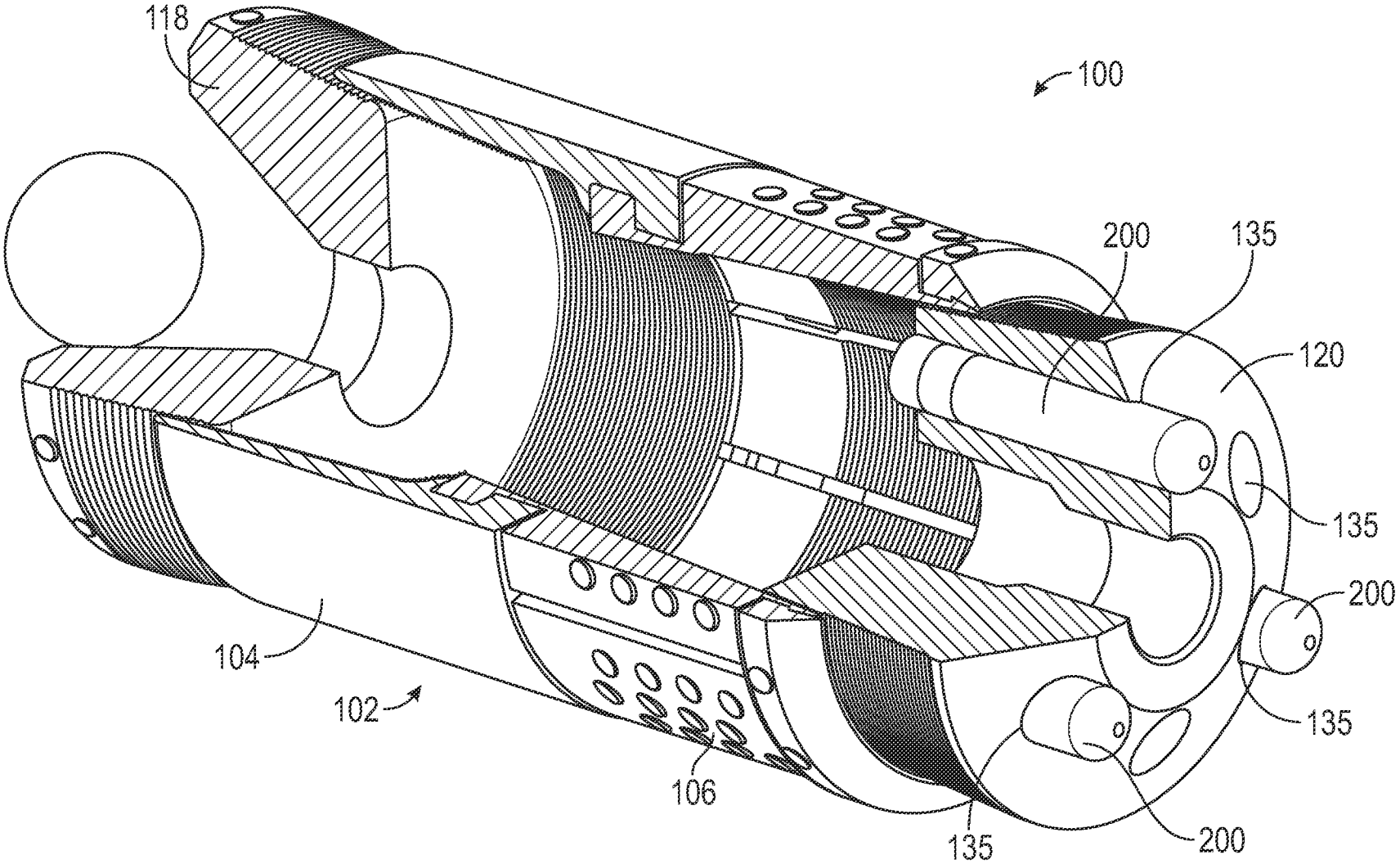
FIG. 1 illustrates a perspective view of a downhole tool with an acid pill, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a downhole tool 100, according to an embodiment. The downhole tool 100 may, in some embodiments, be a frac plug or a frac diverter, but in other embodiments, may be other types of plugs or other downhole tools. The illustrated downhole tool 100 includes a main body 102, which may include a sleeve 104 and a slip assembly 106. The downhole tool 100 may also include a first or "upper" setting member 118 and a second or "lower" setting member 120. In at least one embodiment, as shown, the setting members 118, 120 may be cones, which are configured to be moved toward one another ("adducted") within the main body 102, through operation of a setting assembly (not shown), so as to press the sleeve 104 and the slip assembly 106 radially outwards. In another embodiment, one or more of the members 118, 120 may not be conical, e.g., may be cylindrical and configured to press the sleeve 104 and/or the slip assembly 106 axially. In either embodiment (or others), the first and/or second setting members 118, 120 may remain in the well, e.g., in the main body 102, after the downhole tool 100 is set in position in the well. In another embodiment, the first and/or second setting member 118, 120 may be removed from or drop out of the main body 102 after the downhole tool 100 is set.

The downhole tool 100 may further include one or more acid pills 200 in the second setting member 120, e.g., in a bore 135 formed therethrough. As will be discussed herein, the acid pills 200 are configured to accelerate corrosion of the second setting member 120 and other components of the downhole tool 100. Although there are three acid pills 200 shown in FIG. 1, any number acid pills 200 may be used in the second setting member 120 without departing from the aspects of the current invention.

Figure 2A:
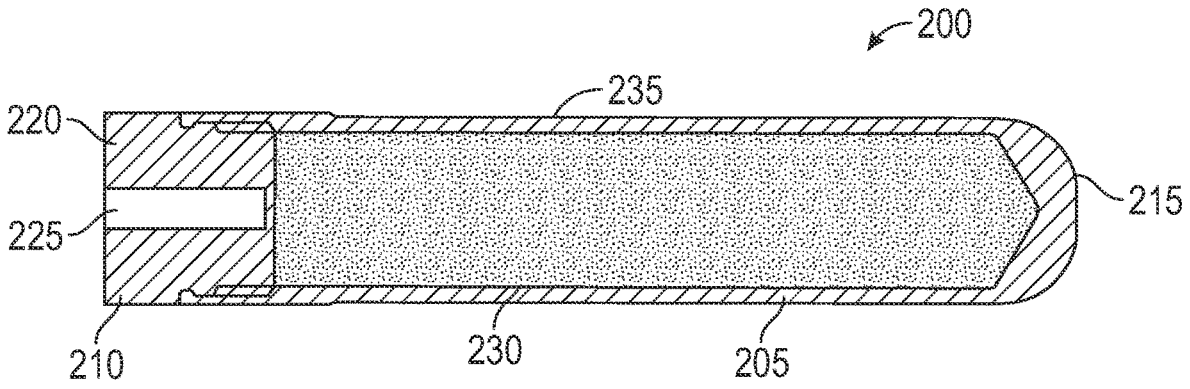
FIGS. 2A and 2B illustrate views of the acid pill, according to an embodiment.
Figure 2B:
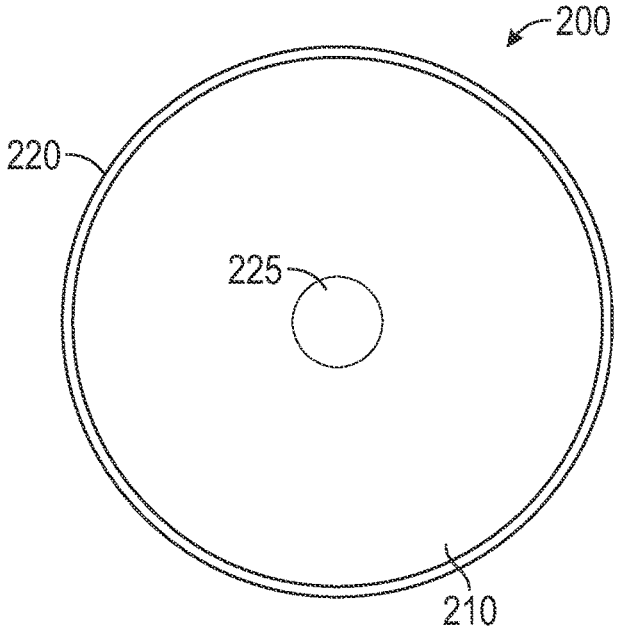

FIGS. 2A and 2B illustrate views of the acid pill 200, according to an embodiment. The acid pill 200 may be generally tubular, with a first axial end 210 that faces uphole when the downhole tool 100 is deployed, and a second axial end 215 that faces downhole. The acid pill 200 may also include a cap 220 and a shell 205, e.g., with the cap 220 connected to the shell 205 at the first axial end 210. The cap 220 and the shell 205 may be formed at least partially from a dissolvable material, such as magnesium, that is configured to dissolve in the wellbore after a certain amount of time, in the presence of well fluid (e.g., containing certain chemicals), or the like. As will be appreciated, the bore 135 formed through the second setting member 120 for placement of the acid pill 200 may weaken the second setting member 120. Thus, the shell 205 and cap 220 of the acid pill 200 may replace at least some of the lost strength when the acid pill 200 is installed into the second setting member 120.

An acid may be contained within the shell 205. For example, the acid may be an acid powder 230. Examples of acid powders 230 include Sulfamic acid and Citric acid. The acid powder 230 is packed inside the shell 205 and the cap 220, which are configured to keep the acid powder 230 dry for a set amount of time in a wellbore environment. The acid may mix with (e.g., dissolve in) the well fluid, and may be configured to increase a rate at which the dissolvable material of the setting members 118, 120, the main body 102, and/or any other component of the tool 100 dissolves.

The acid pill 200 may be designed to have a predetermined release time for the acid (e.g., the acid powder 230). For example, a wall 235 of the shell 205 may have a specific thickness, which can dissolve in fluid in a certain timeframe. In other words, the acid pill 200 may be custom designed to provide a predetermined time release of the acid powder 230 in the fluid environment. Upon exposure to the well fluid, the acid powder 230 mixes with the surrounding fluid to create an acidic solution which is configured to accelerate corrosion of the second setting member 120 and other components of the downhole tool 100. As shown, the acid pill 200 is placed in the second setting member 120. In another embodiment, the acid pill 200 may be placed in other components of the downhole tool 100.

In one embodiment, the cap 220 may include a bore 225 extending partially therethrough, leaving a relatively thin section between the end of the cap 220 and the bore 225. The bore 225 thus reduces the amount of material of the cap 220 to be dissolved in order to expose the acid powder 230 to the well fluid. As a result, the section between the bottom of the bore 225 and the end of the cap 220 may dissolve and form an initial flowpath for well fluid to reach the acid powder 230. Thus, the size (or even presence) of the bore 225 may be used to adjust the predetermined release time for the acid powder 230. In another embodiment, the cap 220 and/or the shell 205 may include one or more pin holes (not shown) to reduce the amount of material in the cap 220 and/or the shell 205, which may serve a similar function of reducing the dissolution time.

Figure 3:
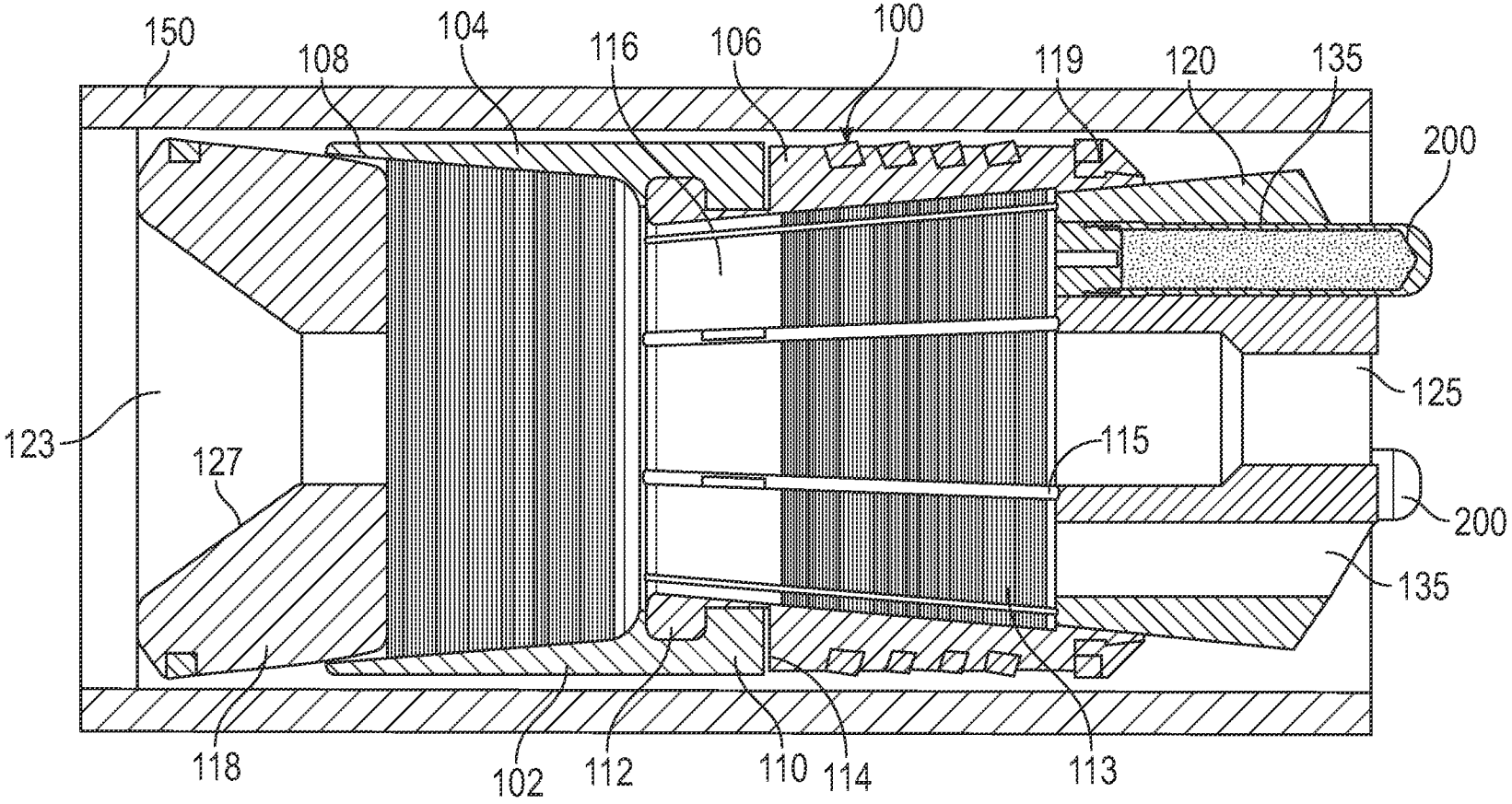
FIG. 3 illustrates side, cross-sectional view of the downhole tool in a run-in configuration, according to an embodiment.

FIG. 3 illustrates side, cross-sectional view of the downhole tool 100 in a run-in configuration, according to an embodiment. The downhole tool 100 is shown within a surrounding tubular 150 (e.g., a liner, a casing, or the wellbore wall). The sleeve 104 may include a first or "upper" end 108 and a second or "lower" end 110. The slip assembly 106 may be coupled to the sleeve 104, proximal to the second end 110. For example, a connection member 112 may extend between and couple together the second end 110 of the sleeve 104 with an axial surface 114 of the slip assembly 106.

The sleeve 104, the slip assembly 106, and the connection member 112 may, in some embodiments, be integral to one another, or may be formed from two or more separate pieces that are connected. Either such example is within the scope of the term "coupled to" as it relates to the sleeve 104, the slip assembly 106, and/or the connection member 112.

The slip assembly 106 may include a plurality of slip segments 113, which may be positioned circumferentially adjacent to one another. For example, a plurality of axial slots 115 may be formed circumferentially between the slip segments 113. In some embodiments, the slots 115 may not extend across the entire axial extent of the slip assembly 106, and thus bridge portions may connect together the circumferentially adjacent slip segments 113 of the slip assembly 106, e.g., proximal to a lower end 119 thereof.

Further, in an embodiment, the sleeve 104, the slip assembly 106, and the connection member 112 may together form a bore 116 extending axially through the entirety of the main body 102. In other embodiments, the bore 116 may extend partially through the main body 102 and/or may be at least partially defined by other structures.

The first and second setting members 118, 120 may be positioned at least partially in the bore 116. The first setting member 118 may initially be positioned partially within the sleeve 104, proximal to the first end 108 thereof. The second setting member 120 may initially be positioned at least partially within the slip assembly 106, e.g., proximal to the lower end 119 thereof. The setting members 118, 120 may be configured to press a section of the sleeve 104 and a section of the slip assembly 106, respectively, radially outward when moved toward one another (e.g., adducted together). The setting members 118, 120 may be adducted together via a setting tool, pressure within the wellbore above the downhole tool 100, or both.

The first and second setting members 118, 120 may be annular, with each providing a through-bore 123, 125 extending axially therethrough, which communicates with the bore 116. The first setting member 118 may additionally include an uphole-facing valve seat 127 in communication with the through-bore 123, which may be configured to receive an obstructing member, and thus seal the bore 116. The through-bore 125 of the second setting member 120 may be configured to engage the setting tool, such that the second setting member 120 may be forced upwards, towards the first setting member 118, as will be described below.

Additionally, as noted above, the second setting member 120 may include the bores 135 formed therein. The acid pills 200 may be inserted or otherwise installed in the bores 135. Some of the bores 135 may be empty during initial run-in, however, and thus the bores 135 without the acid pills may be used as bypass fluid ports, allowing fluid to flow past the second setting member 120 as the downhole tool 100 is lowered into a wellbore.

In some embodiments, the sleeve 104, at least a portion of the slip assembly 106, the connection member 112, and the setting members 118, 120 may be formed from a dissolvable material, such as magnesium, that is configured to dissolve in the wellbore after a certain amount of time, in the presence of certain chemicals, or the like.

Figure 4:
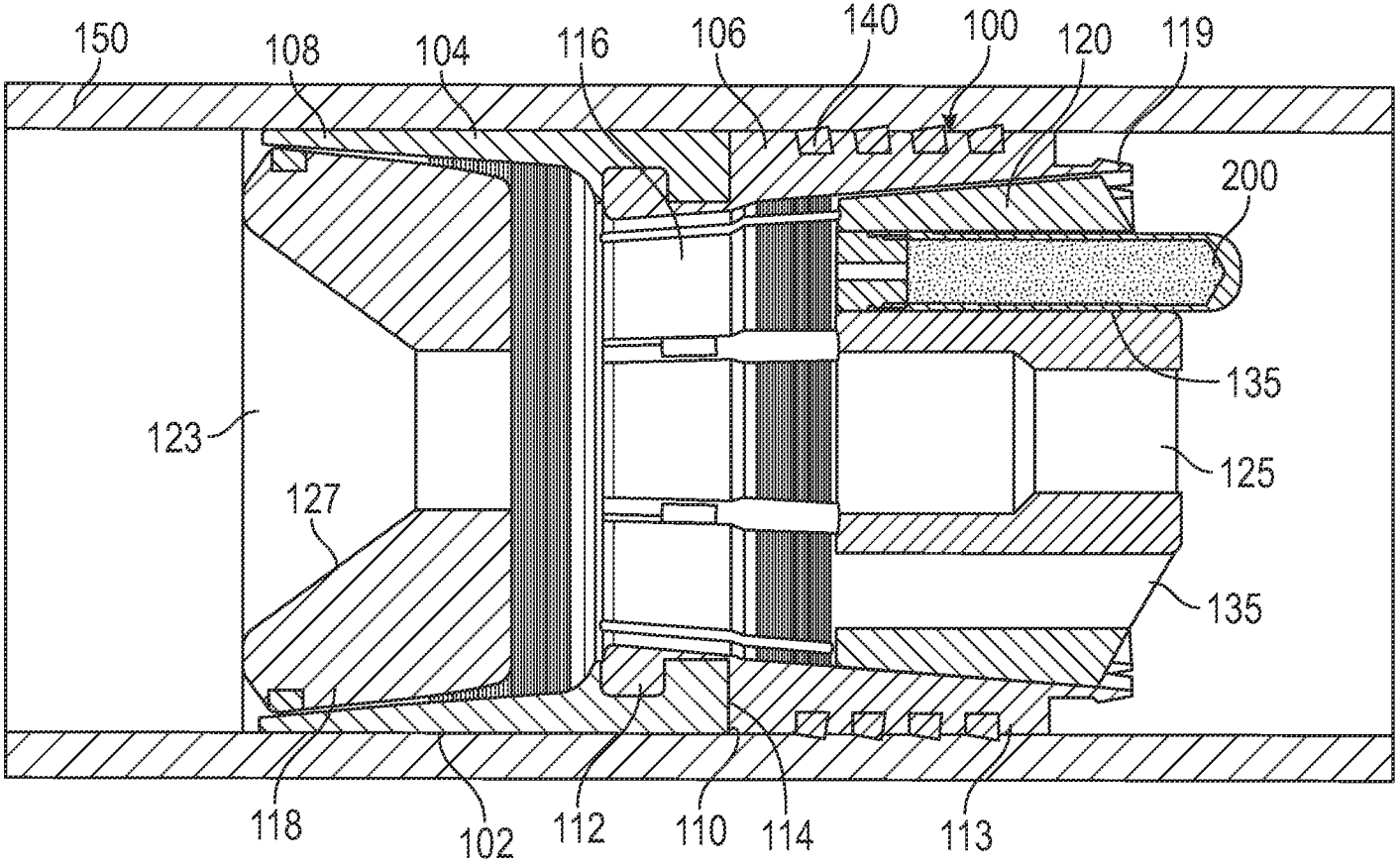
FIG. 4 illustrates side, cross-sectional view of the downhole tool in a set configuration, according to an embodiment.

FIG. 4 illustrates a side, cross-sectional view of the downhole tool 100 in a set configuration, according to an embodiment. In this configuration, the downhole tool 100 may be configured to anchor to and seal within the surrounding tubular 150. To actuate the downhole tool 100 from the run-in configuration of FIG. 3 to the set configuration of FIG. 4, the first and second setting members 118, 120 are adducted toward one another, as mentioned above. In this embodiment, the first and second setting members 118, 120 are cones, and thus moving the first and second setting members 118, 120 together into the main body 102 causes the first and second setting members 118, 120 to progressively press a section of the sleeve 104 and a section of the slip assembly 106, respectively, radially outward.

In the embodiment of FIGS. 3 and 4, as the first setting member 118 advances in the bore 116, an outer surface thereof may force a section of the sleeve 104 outwards, in a generally constant radial orientation around the circumference of the sleeve 104. As such, the sleeve 104 may reduce in thickness and/or axial length, may be squeezed between the first setting member 118 and the surrounding tubular, and may form at least a partial seal therewith.

In contrast, when the second setting member 120 advances in the bore 116, the second setting member 120 may break the slip segments 113 apart. As the second setting member 120 continues into the bore 116, the connection member 112 may also yield or shear, thereby releasing the slip segments 113 not only from connection with one another, but also with connection with the sleeve 104. The wedge action of the second setting member 120 may thus continue forcing the slip segments 113 radially outward, as well as axially toward the second end 110 of the sleeve 104. At some point, the axial surface 114 of the slip assembly 106 (e.g., of the individual slip segments 113) may engage the second end 110, as shown. Further, the slip assembly 106 may be pushed radially outward and axially over the remaining connection member 112, as shown.

Further, the outward expansion of the slip assembly 106, e.g., by breaking the slip segments 113 apart from one another, may result in the slip segments 113 anchoring into the surrounding tubular 150. This may occur before, after, or at the same time that the sleeve 104 forms at least a partial seal with the surrounding tubular. As such, a two-part anchoring, provided by the sleeve 104 and the slip assembly 106, is employed. In some situations, sand may interfere with the holding force reachable by the anchoring of the surface of the sleeve 104 with the surrounding tubular. In such situations, the holding force offered by the slip assembly 106, which may be less prone to interference by sand, may serve to hold the downhole tool 100 in position relative to the surrounding tubular.

As shown, the slip segment 113 may include a thickness that increases as proceeding toward the axial surface 114, e.g., away from the lower end 119. Further, the slip segment 113 may include engaging structures on an outer surface 300 of the slip segment 113. In the illustrated embodiment, the engaging structures include a plurality of buttons or inserts 140, which may be at least partially embedded into the slip segment 113. The inserts 140 may be formed from a suitably hard material, such that the inserts 140 are capable of being pressed into the surrounding tubular, which may be made from steel. Accordingly, the inserts 140 may be made from a carbide or ceramic material. In some embodiments, the engaging structure may include a grit coating, such as WEARSOX®, which is commercially-available from Innovex Downhole Solutions, Inc., may be applied to the outer surface, and may provide increased holding forces. In some embodiments, the engaging structure may include both the inserts 140 and the grit coating, or any other suitable material.

The sleeve 104 may include a continuous outer diameter surface. When expanded, a section of the outer diameter surface may be pressed into engagement with the surrounding tubular 150, thereby forming a metal-metal seal therewith. However, as mentioned above, sand, irregularities of the surrounding tubular, or other conditions may interfere with a complete engagement therebetween. Thus, while at least a partial seal may be maintained between the sleeve 104 and the surrounding tubular, the slip assembly 106 may provide additional holding force to maintain a stationary position of the downhole tool 100 within the surrounding tubular.

Figure 5:
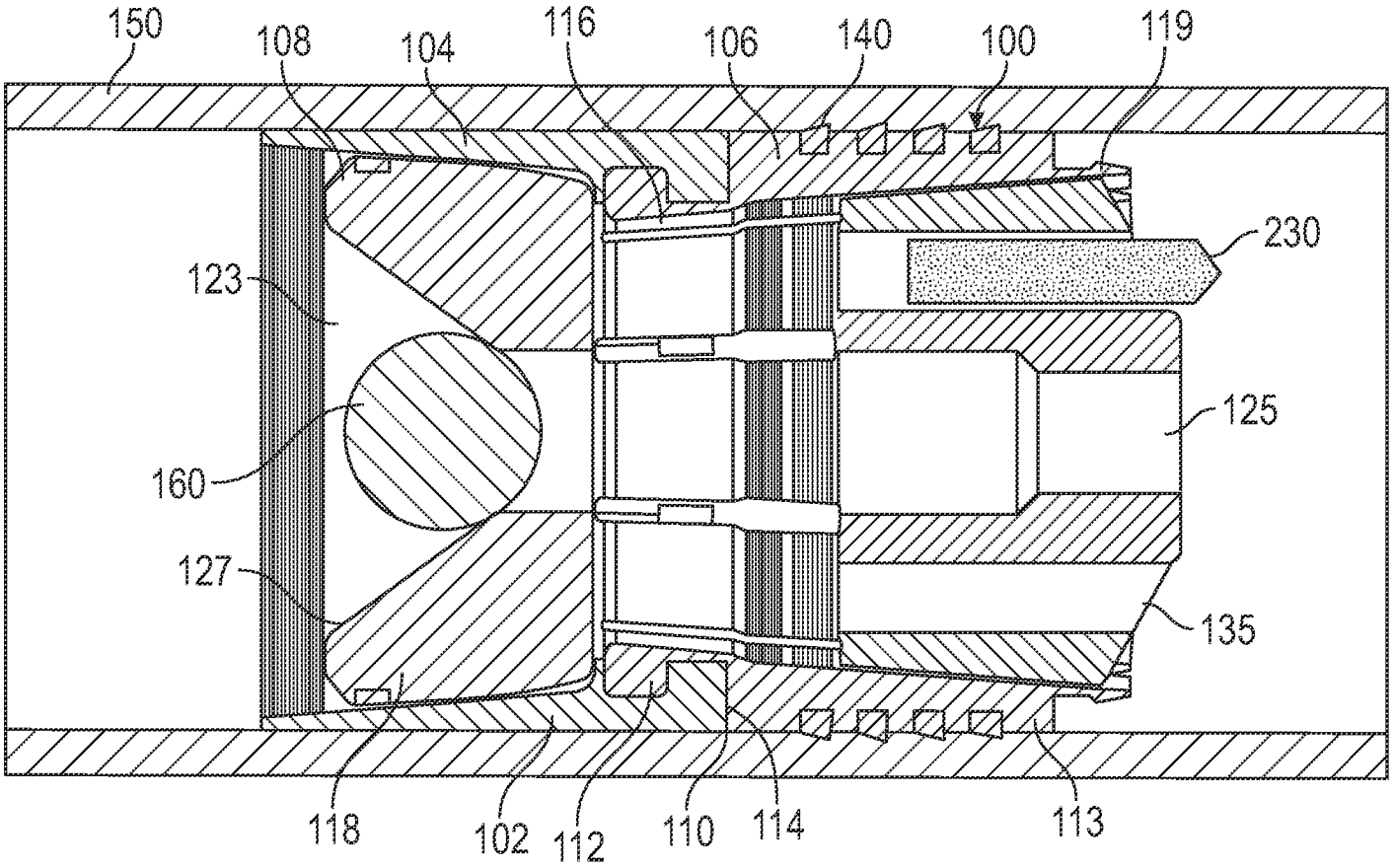
FIG. 5 illustrates side, cross-sectional view of the downhole tool after activation of the acid pill, according to an embodiment.

FIG. 5 illustrates side, cross-sectional view of the downhole tool 100 after activation of the acid pill 200, according to an embodiment. After the downhole tool 100 is in the set position, an obstructing member 160 (e.g., a ball, dart, etc.) is dropped into the downhole tool 100 and lands in the valve seat 127 of the first setting member 118. The obstructing member 160 seals the bore 116. Additionally, the first setting member 118 is urged further in the bore 116 as shown.

As shown in FIG. 5, the cap 220 and the shell 205 have been dissolved and thus exposing the acid powder 230 to the surrounding fluid. The acid powder 230 interacts with the surrounding fluid to create an acid in solution, which accelerates corrosion of the second setting member 120 and other components of the downhole tool 100.

Figure 6:
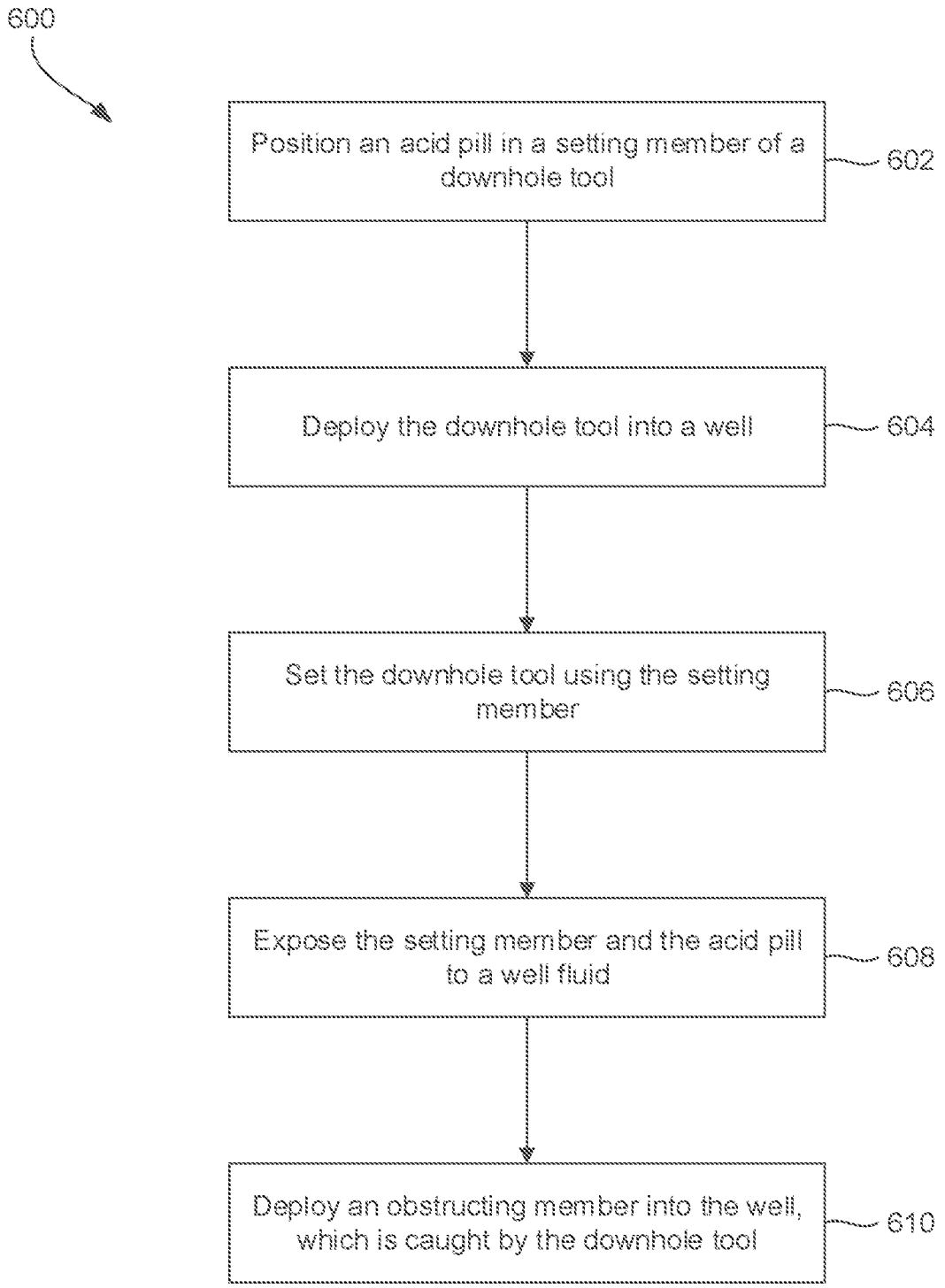
FIG. 6 illustrates a flowchart of a method for using a downhole tool, according to an embodiment.

FIG. 6 illustrates a flowchart of a method 600 for using a downhole tool, such as the downhole tool 100 discussed above, according to an embodiment. The method 600 may be executed using the downhole tool 100, and thus is described herein with reference thereto; however, at least some embodiments of the method 600 may use different structures. Further, it will be appreciated that various aspects of the method 600 may be performed in the order discussed below, or in a different order, without departing from the scope of the present disclosure. Additionally, some aspects of the method 600 may be combined, separated, or performed in parallel/simultaneously.

The method 600 may include positioning an acid pill 200 in a setting member 120 of a downhole tool 100, as at 602. For example, the acid pill 200 may be installed in a bore 135 formed axially through the setting member 120. One or more bores 135 may be empty, free from acid pills, and may thus provide a fluid path therethrough, which may assist in deploying the tool 100 to a depth in a well. Further, the acid pill 200 may be modified to adjust the time it takes to dissolve the acid pill 200 to such an extent that the acid 130 therein is exposed. For example, the bore 225 may be formed and extended to a depth configured to produce a desired time delay for the release of the acid powder 130. Additionally or alternatively, pin holes or other cutaways, etc., may be provided to produce a reduced-thickness in the cap 220 or in the shell 205, so as to reduce dissolution time.

The method 600 may then include deploying the downhole tool 100 into the well, as at 604. The downhole tool 100 may be deployed as part of a wireline, slickline, or any other type of workstring, e.g., into a cased hole, open hole, or any other type of well location. The downhole tool 100 may, for example, be a frac plug that is configured to selectively isolate sections of the well from one another, enabling fluid pressure to be targeted to particular formations. In other embodiments, the downhole tool 100 may be a bridge plug, a packer, or any other type of downhole tool.

The method 600 may then include setting the downhole tool 100 using the setting member 120 to press at least a portion of the downhole tool 100 radially outward, as at 606. For example, the setting member 120 may be a cone, which may be driven into a main body 102, e.g., a slip assembly 106 thereof, so as to drive the slip assembly 106 radially outward to engage a surrounding tubular (e.g., casing, liner, or wellbore wall). In some embodiments, the setting member 120, i.e., the "second" setting member 120 referenced above is adducted toward another setting member 118, i.e., the "fist" setting member 118 discussed above, such that the two setting members 118, 120 each drive a separate portion of the main boxy radially outward. In particular, the first setting member 118 may drive the sleeve 104 of the main body 102 radially outward, and the second setting member 120 may drive the slip assembly 106 of the main body 102 radially outward.

During and/or after deploying at 604 and/or setting at 606, the method 600 may include exposing the downhole tool 100, including the setting member 120 and the acid pill 200, to well fluid, as at 608. Exposing the downhole tool 100 to the well fluid causes at least a portion of the acid pill 200 to dissolve, which exposes an acid (e.g., acid powder 230) contained within the acid pill 200 to the well fluid such that that acid mixes with the well fluid. The acid mixed with the well fluid causes at least a portion of the downhole tool 100 (e.g., a dissolvable material of the setting member 120) to dissolve, e.g., at a rate that exceeds the rate of dissolution of the at least a portion of the downhole tool 100 in the presence of well fluid without the acid mixed therein. That is, the presence of the acid hastens the dissolution of the remainder of the dissolvable part(s) of the downhole tool 100.

In some embodiments, before, during, or after exposing the downhole tool 100 to the well fluid, the method 600 may also include deploying an obstructing member 160 into the well, as at 610. The obstructing member 160 may be caught by another setting member (e.g., the "first" setting member 118) of the downhole tool 100. The obstructing member 160 being caught by the first setting member 118 may prevent fluid flow through the downhole tool 100. As a result, the well fluid in contact with the tool 100, below the obstructing member 160, may be relatively stationary, and thus the acid, when released, may form an acidic concentration that contacts the dissolvable portion of the downhole tool 100 and increases the rate of dissolution thereof, as discussed above.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a main body;

a setting member configured to press the main body radially outwards so as to set the main body with a surrounding tubular, wherein the setting member is made at least partially from a dissolvable material configured to dissolve in a well fluid, and wherein the setting member defines a bore therein; and an acid pill positioned in the bore of the setting member, wherein the acid pill comprises a cap defining a bore therein, wherein the acid pill contains an acid therein, wherein the cap is configured to dissolve such that the cap bore provides at least a partial communication path to the acid to allow the acid to mix with the well fluid, and wherein the acid mixed in the well fluid increases a rate at which the dissolvable material of the setting member dissolves in the well fluid in comparison to the rate at which the dissolvable material of the setting member dissolves in the well fluid without the acid mixed therein.

2. The downhole tool of claim 1, wherein the main body comprises a sleeve and a slip assembly, and wherein the setting member is configured to press the slip assembly radially outward, so as to at least partially set the main boy in the surrounding tubular.

3. The downhole tool of claim 2, wherein the setting member is a second setting member, and wherein the downhole tool further comprises a first setting member that engages the sleeve, such that the first setting member is configured to press the sleeve radially outward into engagement with the surrounding tubular.

4. The downhole tool of claim 3, wherein the first setting member comprises a first cone, and the second setting member comprises a second cone, and wherein the first and second cones are configured to be adducted within the main body to press at least a portion of the main body radially outward.

5. The downhole tool of claim 4, wherein the acid pill further comprises a shell, wherein the shell, the cap, or both are configured to dissolve and permit communication of the well fluid with the acid after the first and second cones are adducted together to set the main body in the surrounding tubular.

6. The downhole tool of claim 3, wherein the first setting member comprises an upwardly-facing valve seat configured to receive an obstruction member, to block fluid flow through the downhole tool.

7. The downhole tool of claim 6, wherein the acid pill further comprises a shell and the cap connected to the shell, the acid being contained within the shell and the cap, and wherein the cap is configured to dissolve such that the bore provides at least a partial communication path to the acid within the shell.

8. The downhole tool of claim 7, wherein the cap is located closer to a first end of the shell than to a second end of the shell, and wherein the first end and the cap are located closer to the first setting member than the second end.

9. The downhole tool of claim 1, wherein the setting member comprises a plurality of bores including the bore, and wherein at least one of the plurality of bores provides a through-port for communication of well fluid past the setting member.

10. The downhole tool of claim 1, wherein the acid within the acid pill comprises an acid powder.

11. The downhole tool of claim 1, further comprising a shell connected to the cap, wherein the shell and the cap form a solid insert that is configured to be inserted into or removed from the bore in the setting member, and wherein the acid is contained within the solid insert.

12. The downhole tool of claim 1, wherein the bore in the setting member comprises a first bore and a second bore that are both radially offset from a central longitudinal axis through the setting member, wherein the acid pill is positioned in the first bore, and wherein the second bore is empty and provides a path of fluid communication through the setting member.

13. A downhole tool, comprising:

a main body;

a first cone received at least partially into a first end of the main body;

a second cone received at least partially into a second, opposite end of the main body, wherein the first and second cones are configured to be advanced into the main body and adducted together so as to force the main body radially outward, and wherein the second cone comprises one or more bores therein; and an acid pill received in one of the one or more bores, wherein the acid pill comprises a cap defining one or more bores therein, wherein the cap is configured to dissolve such that the cap bore provides at least a partial communication path to an acid in the acid pill to allow the acid configured to mix with well fluid so as to increase a rate of dissolution of the second cone in the well fluid in comparison to a rate of dissolution of the second cone in the well fluid without the presence of the acid.

14. The tool of claim 13, wherein the main body comprises a sleeve extending from the first end and configured to be pressed outward by advancement of the first cone therein, and a slip assembly extending from the second end and configured to be pressed outward by advancement of the second cone therein.

15. The tool of claim 13, wherein the acid pill comprises a shell in which the acid is contained that is configured to dissolve in the well fluid.

16. The tool of claim 15, wherein the is coupled to an uphole end of the shell, and wherein the cap is configured to dissolve at least at a bottom of the one or more bores, so as to expose the acid to the well fluid.

17. The tool of claim 13, wherein the acid comprises an acid powder.

18. The tool of claim 13, wherein the one or more bores of the second cone comprises a plurality of bores, and wherein at least one of the plurality of bores is empty so as to provide fluid communication through the second cone.

19. The tool of claim 18, wherein the first cone comprises an upwardly facing valve seat configured to catch an obstructing member, so as to prevent fluid flow in in at least one direction through the main body.

20. A method, comprising:

positioning an acid pill in a setting member of a downhole tool, wherein the acid pill comprises a cap defining a bore therein;

deploying the downhole tool into a well;

setting the downhole tool using the setting member to press at least a portion of the downhole tool radially outward; and exposing the downhole tool to a well fluid, wherein exposing the downhole tool to the well fluid causes at least a portion of the cap to dissolve such that the bore provides at least a partial communication path to, an acid contained within the acid pill to allow the acid to mix with the well fluid, and wherein the acid mixed with the well fluid causes at least a portion of the downhole tool to dissolve.

21. The method of claim 20, further comprising deploying an obstructing member into the well, the obstructing member being caught by another setting member of the downhole tool.

22. The method of claim 20, wherein the setting member comprises a second setting member, and the downhole tool comprises a first setting member, and wherein setting the downhole tool comprises adducting the first and second setting members together within a main body of the downhole tool, so as to press a sleeve of the main body and a slips assembly of the main body radially outwards.

* * * * *